United States Patent [19]

Ravitts

[11] 4,089,620

[45] May 16, 1978

[54] FLOATING PUMPING DEVICE

[75] Inventor: Richard B. Ravitts, Rockford, Ill.

[73] Assignee: Riga, Inc., Rockford, Ill.

[21] Appl. No.: 735,438

[22] Filed: Oct. 26, 1976

[51] Int. Cl.[2] ..... F04B 21/00

[52] U.S. Cl. ..... 417/61; 261/91; 415/7; 417/238; 366/270

[58] Field of Search ..... 417/61, 236, 238; 415/7, 121 G, 126, 209; 239/182; 210/242 R, 242 A; 259/95, 96; 261/91

[56] References Cited

U.S. PATENT DOCUMENTS

| | | | |
|---|---|---|---|
| 3,320,160 | 5/1967 | Welles et al. | 261/91 |
| 3,497,185 | 2/1970 | Dively | 415/7 |
| 3,524,629 | 8/1970 | Culwell | 415/7 |
| 3,640,514 | 2/1972 | Albritton | 417/61 |
| 3,680,845 | 8/1972 | Carlsmith et al. | 210/242 X |
| 3,735,926 | 5/1973 | Ravitts | 261/91 |
| 3,846,516 | 11/1974 | Carlson | 210/242 A |
| 3,856,272 | 12/1974 | Ravitts | 417/61 X |
| 3,865,909 | 2/1975 | Cramer | 261/91 |

*Primary Examiner*—William L. Freeh
*Assistant Examiner*—Edward Look
*Attorney, Agent, or Firm*—Leydig, Voit, Osann, Mayer & Holt, Ltd.

[57] ABSTRACT

A motor-driven propeller is disposed within a draft tube beneath a buoyant float and is adapted to pump water upwardly through the draft tube. In one mode of operation, the pumping device functions as an aerator in that the water pumped upwardly through the draft tube flows upwardly through an opening in the float and is deflected across the upper side of the float and into the atmosphere by a diffuser plate spaced above the opening. The pumping device can be converted into a flow developer by positioning the diffuser plate beneath the opening in the float and, when the plate is so positioned, water pumped upwardly through the draft tube strikes the plate and is deflected outwardly beneath the lower side of the float.

7 Claims, 4 Drawing Figures

FLOATING PUMPING DEVICE

BACKGROUND OF THE INVENTION

This invention relates to a device adapted to float in a body of liquid in a basin or the like and to pump water or other liquid contained in the basin for the purpose of conditioning the water. One device of this type may, for example, be a floating aerator which pumps water upwardly from the basin and sprays the water into the atmosphere in order to enrich the oxygen content of the water, to scrub undesirable gases from the water or to cool large quantities of water for recirculation. A floating aerator is disclosed in Ravitts U.S. Pat. No. 3,416,729 and includes a float formed with a central opening through which the water is pumped prior to being sprayed into the atmosphere.

Another type of floating pump device is commonly referred to as a mixer or flow developer. A flow developer circulates water in a predetermined pattern beneath the surface of the parent body in order to effect mixing of suspended biological solids in the water, to mix different types of liquids or to provide anaerobic mixing.

SUMMARY OF THE INVENTION

The primary aim of the present invention is to provide a unique floating pumping device which may serve either as an aerator to spray water into the atmosphere or as a flow developer to effect circulation and mixing of the water below the surface of the parent body.

A related object is to provide a pumping device which may be quickly and easily converted from an aerator to a flow developer or vice versa.

A more detailed object is to provide a liquid pumping device having a diffuser plate which may be located above the float so as to deflect into the atmosphere the water pumped upwardly through the opening in the float. The diffuser plate alternatively may be located beneath the float to cover the opening therein and to deflect the upwardly pumped water outwardly beneath the float so that the water may circulate and mix below the surface of the parent body.

The invention also resides in the novel and comparatively simple manner by which the diffuser plate may be mounted either above or below the float and by which the plate may be located to establish a discharge orifice of optimum size in either of the two positions of the plate.

These and other objects and advantages of the invention will become more apparent from the following detailed description when taken in conjunction with the accompanying drawings.

DETAILED DESCRIPTION OF THE PREFERRED EMBODIMENT

Figure 1:
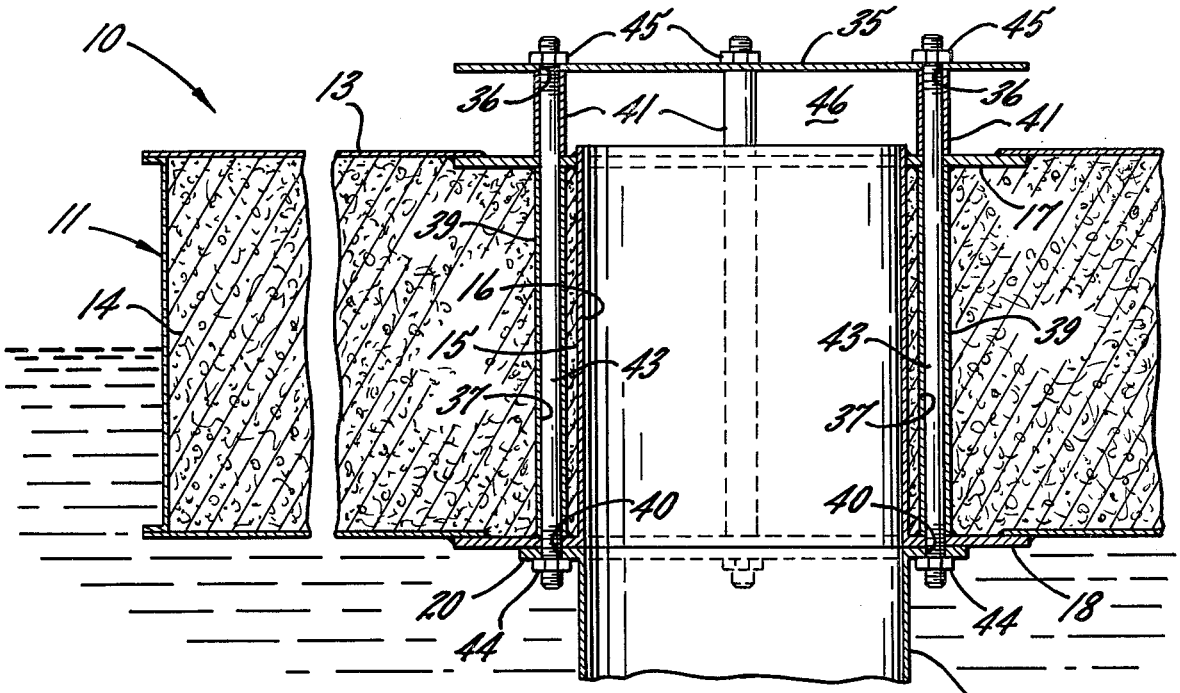
FIG. 1 is a perspective view of a new and improved pumping device incorporating the unique features of the present invention and shows the device being used as an aerator.
Figure 1:
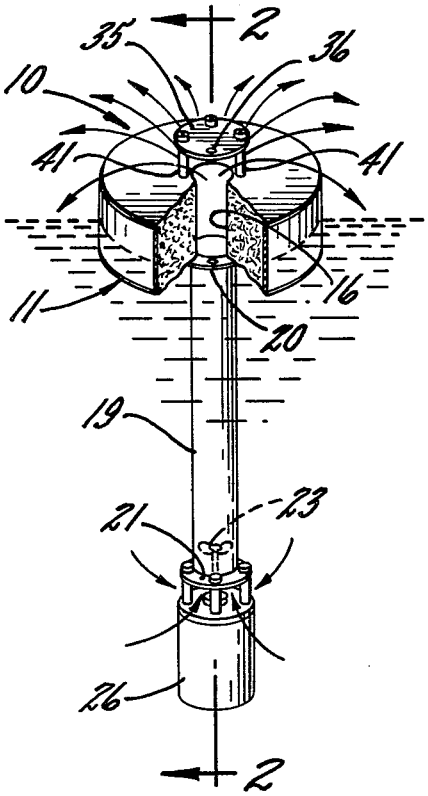

As shown in the drawings for purposes of illustration, the invention is embodied in a device 10 adapted to float in a body of liquid such as water in a pond, a pool or a waste treatment basin and serving to pump the water upwardly so as to treat the water and impart desirable characteristics thereto. The pumping device 10 herein includes a buoyant float 11 formed by a cylindrical stainless steel outer shell 13 which is filled with a low density material 14 such as polyurethane foam. The float may be moored in a fixed location in the basin by cables (not shown) connected to the shell and extending to the edge of the basin.

Extending through the center of the float 11 is a stainless steel sleeve 15 defining an opening 16 which may accommodate the flow of water upwardly through the float, the upper end of the sleeve extending a short distance (e.g., $\frac{1}{8}$ inch) above the upper side of the float. Upper and lower annular flanges 17 and 18 are welded to the ends of the sleeve 15 and also are welded to the shell in order to attach the sleeve to the float.

A stainless steel draft tube 19 is located beneath the float 11 in axial alinement with the sleeve 15 and is formed with upper and lower mounting flanges 20 and 21 projecting radially outwardly from its upper and lower ends. Disposed within the draft tube is an axial flow propeller 23 which is adapted to be rotated in a direction to draw water into the lower end of the draft tube and to pump such water upwardly out of the upper end of the draft tube. To rotate the propeller, an electric motor 24 of the submersible type is located beneath the draft tube and includes a vertical shaft 25 which is connected to the propeller. The motor is housed within a sealed case 26 having an upper wall 27 which is attached to the lower flange 21 of the draft tube by angularly spaced screws 29. Tubular sleeves 30 are telescoped over the screws and keep the wall 27 spaced below the flange 21 so that water may be drawn radially inwardly between the wall and the flange as shown in FIG. 1 and then sucked upwardly into the lower end of the draft tube 19 by the propeller 23.

Leading into one side of the case 26 is a conduit 31 which extends to a power supply (not shown) at the edge of the basin and which encloses electrical wires 33 for conducting current to the motor 24. Dielectric oil from a pressurized reservoir (not shown) also is conducted through the conduit and fills the case 26 so as to lengthen the life and reduce the operating temperature of the motor and to prevent moisture from intruding the bearings of the motor. The oil also increases the efficiency and raises the service factor of the motor.

Figure 2:
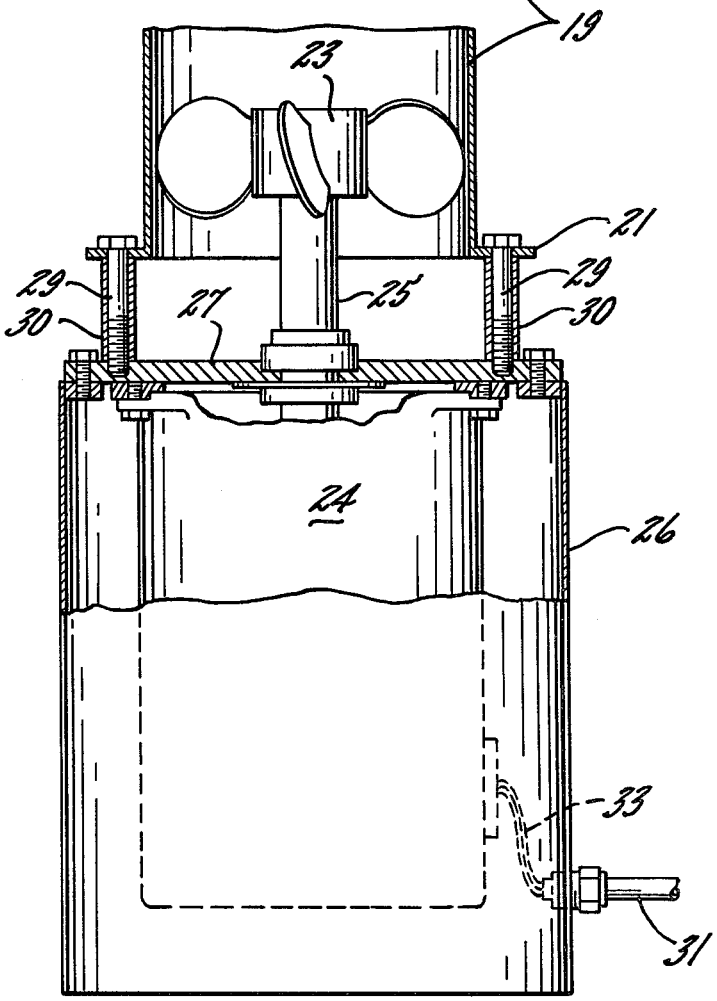
FIG. 2 is an enlarged fragmentary cross-section taken substantially along the line 2—2 of FIG. 1.
Figure 3:
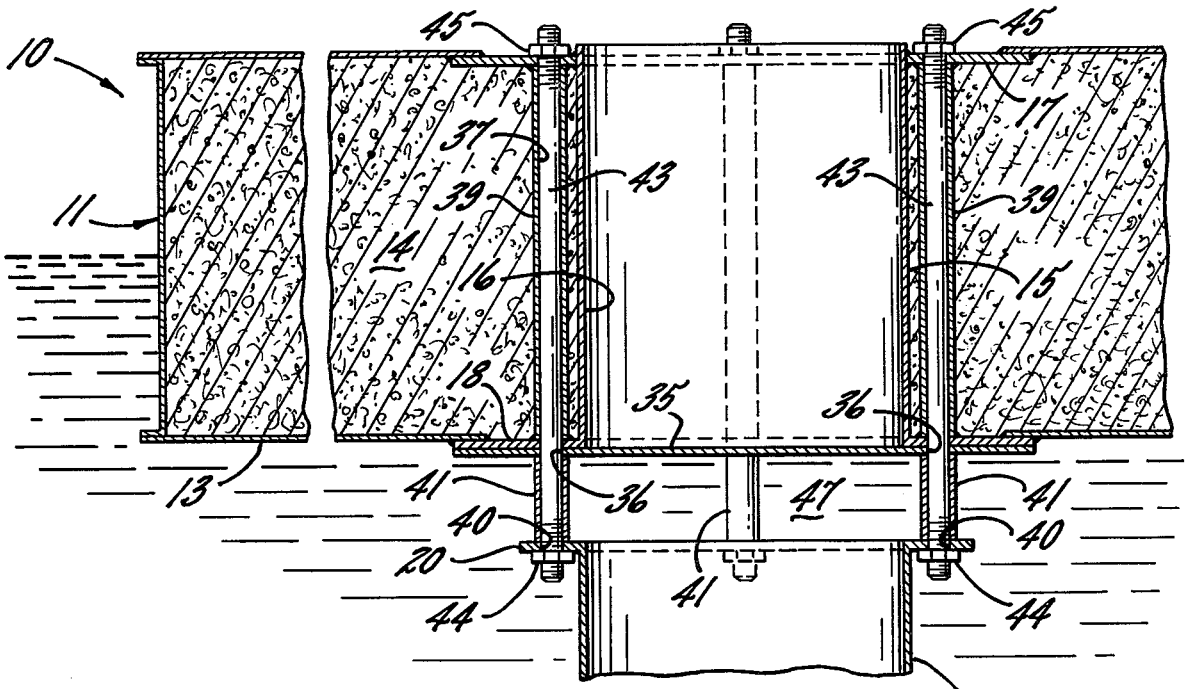
FIG. 3 is another perspective view of the pumping device and shows the device being used as a flow developer.
Figure 3:
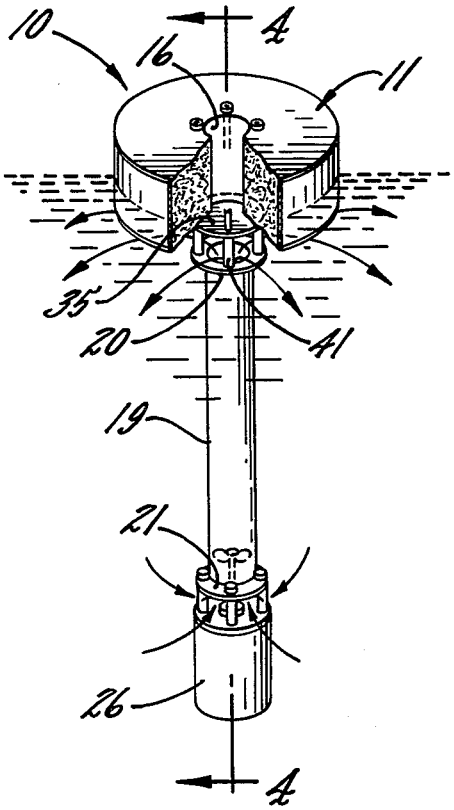
Figure 4:
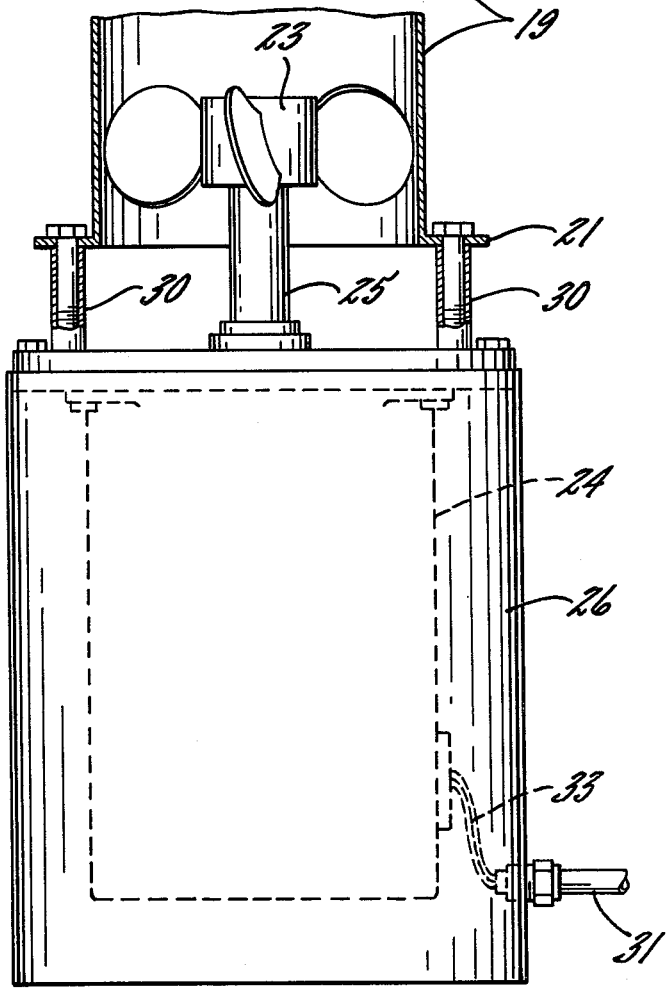
FIG. 4 is an enlarged fragmentary cross-section taken substantially along the line 4—4 of FIG. 3.

The present invention contemplates the provision of a diffuser plate 35 for radially deflecting the water pumped upwardly through the draft tube 19 and further contemplates selectively attaching the diffuser plate to the float 11 at a position either above or below the opening 16 so that the device 10 may serve either as an aerator (FIGS. 1 and 2) or as a flow developer (FIGS. 3 and 4). When the diffuser plate 35 is located above the opening 16 as shown in FIGS. 1 and 2, the water in the draft tube 19 is pumped upwardly through the opening, impinges against the diffuser plate, and is deflected upwardly and radially across the upper side of the float and into the atmosphere so as to cool the water or enrich the oxygen content thereof. With a few simple disassembly and re-assembly steps, the diffuser plate 35 may be re-positioned beneath the float 11 and in spaced relation with the upper end of the draft tube 19 as shown in FIGS. 3 and 4. When so positioned, the plate 35 covers the lower end of the opening 16 such that the water flowing upwardly out of the draft tube impinges against the plate and is deflected radially outwardly beneath the lower side of the float for recirculation beneath the surface of the parent body of water.

More specifically, the diffuser plate 35 is in the form of a flat circular disc whose diameter is nearly twice as great as the diameter of the opening 16 through the float 11. Formed through and spaced angularly around the diffuser plate are four vertically extending apertures 36 which are adapted to be positioned in alinement with vertical holes 37 extending through the float 11 and spaced anguarly around the opening 16. Metal sleeves 39 are telescoped into the holes 37 and are welded to the flanges 17 and 18 to keep the foam 14 from collapsing into the holes. The apertures 36 and the holes 37 also are alined with apertures 40 extending vertically through the upper flange 20 of the draft tube 19.

In keeping with the invention, tubular spaces 41 are employed to hold the diffuser plate 35 in vertically spaced relation with the upper side of the float 11 when the pumping device 10 is used as an aerator (FIGS. 1 and 2) and to hold the diffuser plate in vertically spaced relation with the upper flange 20 of the draft tube 19 when the pumping device is used as a flow developer (FIGS. 3 and 4). When the plate is located above the float as shown in FIG. 2, the spacers 41 are located between the lower side of the plate and the upper side of the flange 17 and are positioned in alinement with the apertures 36 and the sleeves 39. Threaded rods or bolts 43 extend through the apertures 36, the spacers 41 and the sleeves 39 and also extend through the apertures 40 in the flange 20. Lock nuts 44 are threaded onto the lower ends of the rods and engage the lower side of the flange 20 so as to clamp the upper side of that flange against the lower side of the flange 18. Accordingly, water pumped upwardly through the draft tube 19 flows into the opening 16 and is discharged out of the upper end thereof.

The diffuser plate 35 is clamped to the upper ends of the spacers 41 by lock nuts 45 which are threaded onto the upper ends of the rods 43. Thus, the diffuser plate is held in vertically spaced relation with the upper end of the opening 16, the plate herein being spaced about one inch above the upper end of the sleeve 15. Accordingly, the plate 35 coacts with the upper end of the sleeve 15 to define a radially opening orifice 46 around the upper side of the float 11.

When the propeller 23 pumps water upwardly through the draft tube 19, such water is forced through the opening 16 and then strikes the underside of the diffuser plate 35. As a result, the upwardly flowing water is deflected radially and is discharged upwardly and outwardly from the orifice 46 and into the atmosphere with relatively high turbulence and in an umbrella-shaped pattern as shown in FIG. 1. Thus, the water makes intimate interface contact with oxygen molecules in the atmosphere so as to increase the oxygen content of the water.

To convert the pumping device 10 from an aerator to a flow developer (see FIGS. 3 and 4), the nuts 45 on the upper ends of the rods 43 are removed to permit the diffuser plate 35 and the spacers 41 to be slipped upwardly off of the rods. The nuts 45 then are replaced on the upper ends of the rods 43 and the latter are allowed to slide downwardly in the sleeves 39 so as to permit the upper flange 20 of the draft tube 19 to move downwardly away from the flange 18 of the float 11. Downward movement of the rods 43 is stopped when the nuts 45 engage the upper flange 17 of the float.

The nuts 44 then are removed from the lower ends of the rods 43 to permit removal of the flanges 20 of the draft tube 19 from the rods. Thereafter, the diffuser plate 35 and the spacers 41 are slipped onto the lower ends of the rods 43, the flange 20 is replaced on the lower ends of the rods, and the nuts 44 are re-threaded onto the rods beneath the flange. when the nuts 44 are tightened, the flange 20 is drawn tightly against the lower ends of the spacers 41 which, in turn, hold the diffuser plate 35 tightly against the underside of the flange 18. The diffuser plate 35 thus covers the lower end of the opening 16 and is held in spaced relation with the flange 20 so that a radially opening orifice 47 (FIG. 4) having a height slightly greater than one inch is formed between the flange 20 and the plate 35. Accordingly, water flowing upwardly out of the draft tube 19 is prevented from passing into the opening 16 but instead impinges against the underside of the diffuser plate 35 and is deflected radially out of the orifice 47 and beneath the lower side of the float 11. The water thus circulates entirely beneath the surface of the parent body and is not sprayed into the atmosphere.

The motor 24 preferably is reversible and thus, when the device 10 is being used as a flow developer, the direction of rotation of the propeller 23 may be reversed so as to circulate the water by drawing the water through the orifice 47 and downwardly into the upper end of the draft tube 19 and by pumping the water out of the lower end of the draft tube. When the direction of rotation of the propeller is reversed, the propeller is placed on the shaft 25 in an inverted position so as to keep the formed leading edge of the propeller in leading relationship with respect to the direction or rotaion.

From the foregoing, it will be apparent that the present invention brings to the art a liquid pumping device 10 which may be converted from an aerator to a flow developer or vice versa. The conversion can be effected quickly and easily simply by re-positioning the parts and without need of using any additional parts or storing any surplus parts.

I claim:

1. A device for pumping liquid, said device comprising a float having an upright opening extending therethrough, an upright draft tube located beneath said float in alinement with said opening and having open upper and lower ends, a flange projecting radially from the upper end of said draft tube and having a series of angularly spaced and vertically extending apertures formed therein, a propeller located within said draft tube, a submersible motor secured to and spaced from the lower end of said draft tube and operable to rotate said propeller about an upright axis and in a direction to cause said propeller to draw liquid into the lower end of said draft tube between said tube and said motor and to pump such liquid out of the upper end of said draft tube, upright holes extending through said floating and spaced angularly around said opening in alinement with the apertures in said flange, a diffuser plate having angularly spaced apertures alined with said holes and the apertures, in said flage, threaded rods extending through said holes and sized to extend into the apertures in said flange and said plate and having a vertical dimension greater than the vertical dimension of said float, means on the upper ends of said rods for preventing the upper ends of said rods from sliding downwardly through said holes and the apertures in said plate, means on the lower ends of said rods and engageable with said flange to draw said flange upwardly relative to said rods, and a series of tubular spacers having inside diameters sufficiently large to receive said rods and having outside diameters sufficiently large to prevent said spacers from moving through said holes and the apertures in said flange and said plate, said spacers and said plate being positionable on the upper end portions of said rods with the spacers located between the upper side of said float and the lower side of said plate and with said plate spaced above and overlying the upper end of said opening and clamped against the upper ends of said spacers by said means on the upper ends of said rods, said means on the lower ends of said rods holding the upper side of said flange in engagement with the lower side of said float whereby liquid pumped upwardly through said draft tube passes upwardly through said opening and is deflected radially outwardly across the upper side of said float by said plate, said spacers and said plate alternatively being positionable on the lower end portions of said rods with said spacers located between the upper side of said flange and the lower side of said plate and with said plate located between the upper ends of said spacers and the lower side of said float and underlying the lower end of said opening, said means on said upper ends of said rods preventing downward movement of said rods, and said means on said lower ends of said rods coacting with said spacers to hold said flange and said plate in vertically spaced relationship whereby liquid pumped upwardly through said tube impinges against said plate and is deflected radially outwardly between said flange and said plate.

2. A device as defined in claim 1 in which said rods are threaded on each end, said means on the upper and lower ends of said rods comprising nuts threaded onto said rods.

3. A device for pumping liquid, said device comprising a float having an upright opening extending therethrough, an upright draft tube located beneath said float in alinement with said opening and having open upper and lower ends, a flange projecting radially from the upper end of said draft tube and engaging the lowr side of said float, a propeller located within said draft tube, a submersible motor secured to and spaced from the lower end of said draft tube and operable to rotate said propeller about an upright axis and in a direction to cause said propeller to draw liquid into the lower end of said draft tube between said tube and said motor and to pump such liquid out of the upper end of said draft tube, upright holes spaced angularly around said opening and extending through said float, tubular spacers alined with said holes and located with their lower ends engaging the upper side of said float with their upper ends projecting above the upper end of said opening, bolts extending downwardly through said spacers, said holes and said flange in the order named, means on the lower ends of said bolts and engageable with the lower said of said flange to clamp the flange to the lower side of said float whereby liquid pumped upwardly through said draft tube flows upwardly through said opening in said float, a diffuser plate spaced upwardly from and overlying the upper end of said opening whereby liquid flowing upwardly out of said opening impinges against said diffuser plate and is directed radially outwardly between the diffuser plate and the upper side of the float, said diffuser plate having apertures receiving the upper end portions of said bolts and being located with its lower side engaging the upper ends of said spacers, and means on the upper ends of said bolts and engageable with the upper side of said diffuser plate to clamp the diffuser plate to the upper ends of said spacers.

4. A device as defined in claim 3 in which the means on at least one end of each bolt is releasable to enable said spacers and said diffuser plate to be removed from the upper end portions of said bolts, to enable said bolts to be shifted downwardly within said holes with the means on the upper ends of said bolts engaging the upper side of said float to limit downward movement of said bolts, and to enable said diffuser plate and said spacers to be re-positioned onto the lower end portions of said bolts with said diffuser plate engaging the lower side of said float and covering said opening and with said spacers being sandwiched between the lower side of said diffuser plte and the upper side of said flange to hold said plate and said flange in vertically spaced relation and to form a radially opening orifice for liquid flowing out of the upper end of said draft tube and impinging against said plate.

5. A device for pumping liquid, said device comprising a float having an upright opening extending therethrough, an upright draft tube located beneath said float in alinement with said opening and having open upper and lower ends, a flange projecting radially from the upper end of said draft tube and spaced below the lower side of said float, a propeller located within said draft tube, a submersible motor secured to and spaced from the lower end of said draft tube and operable to rotate said propeller about an upright axis and in a direction to cause said propeller to draw liquid into the lower end of said draft tube between said tube and said motor and to pump such liquid out of the upper end of said draft tube, upright holes spaced angularly around said opening and extending through said float, tubular spacers alined with said holes and located with their upper ends adjacent the lower side of said float and with their lower ends projecting below the lower end of said opening and engaging the upper side of said flange, bolts extending downwardly through said holes, said spacers and said flange in the order named, means on the upper ends of said bolts and engageable with the upper side of said float to prevent downward movement of said bolts, a diffuser plate spaced upwardly from said flange and engaging the lower side of said float, said diffuser plate covering the lower end of said opening whereby liquid flowing upwardly from said draft tube impinges against said diffuser plate and is directed radially outwardly between said diffuser plate and said flange, said diffuser plate having apertures receiving the lower end portions of said bolts and being located with its lower side engaging the upper ends of said spacers, and means on the lower ends of said bolts and engageable with the lower side of said flange to clamp said diffuser plate between the lower side of said float and the upper ends of said spacers.

6. A device as defined in claim 5 in which the means on at least one end of each bolt is releasable to enable said spacers and said diffuser plate to be removed from the lower end portions of said bolts, to enable said bolts to be shifted upwardly within said holes with the means on the lower ends of said bolts engaging the lower side of said flange to clamp the upper side of said flange to the lower side of said float, and to enable said diffuser plate and said spacers to be re-positioned onto the upper end portions of said bolts with said diffuser plate being spaced above and overlying the upper end of said opening and with said spacers being sandwiched between the lower side of said diffuser plate and the upper side of said float to hold said plate in vertically spaced relation with the upper end of said opening and to form a radially opening orifice for liquid flowing out of the upper end of said opening and impinging against said plate.

7. A device as defined in claim 5 in which said motor is selectively reversible so as to rotate said propeller in a direction to draw liquid into the upper end of said draft tube and to pump liquid out of the lower end of said draft tube.

* * * * *